US009810030B2

(12) United States Patent
Logan et al.

(10) Patent No.: US 9,810,030 B2
(45) **Date of Patent: *Nov. 7, 2017**

(54) MUD MOTOR WITH INTEGRATED ABRASION-RESISTANT STRUCTURE

(71) Applicant: EVOLUTION ENGINEERING INC., Calgary (CA)

(72) Inventors: Aaron W. Logan, Calgary (CA); Kevin Kalman, Okotoks (CA); Vincent Gille Berube, Okotoks (CA); Daniel W. Ahmoye, Calgary (CA)

(73) Assignee: Evolution Engineering Inc., Calgary, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/894,322

(22) PCT Filed: Jun. 3, 2014

(86) PCT No.: PCT/CA2014/050512

§ 371 (c)(1),
(2) Date: Nov. 25, 2015

(87) PCT Pub. No.: WO2014/194420

PCT Pub. Date: Dec. 11, 2014

(65) Prior Publication Data

US 2016/0108683 A1 Apr. 21, 2016

Related U.S. Application Data

(60) Provisional application No. 61/830,524, filed on Jun. 3, 2013.

(51) Int. Cl.
*E21B 17/10* (2006.01)
*E21B 41/00* (2006.01)
(Continued)

(52) U.S. Cl.
CPC ..... *E21B 17/10* (2013.01); *E21B 4/02* (2013.01); *E21B 17/00* (2013.01); *E21B 41/00* (2013.01)

(58) Field of Classification Search
CPC ..... E21B 17/00; E21B 17/10; E21B 4/02
See application file for complete search history.

(56) References Cited

U.S. PATENT DOCUMENTS 5,415,237 A * 5/1995 Strattan ..... E21B 34/10 166/324
6,213,229 B1 4/2001 Majkovic
(Continued)

FOREIGN PATENT DOCUMENTS

CN 202348274 U 7/2012
WO 9712116 A1 4/1997
(Continued)

*Primary Examiner* — Shane Bomar
(74) *Attorney, Agent, or Firm* — Oyen Wiggs Green & Mutala LLP

(57) ABSTRACT

A housing for a mud motor is disclosed. The housing comprises a female member comprising a female mating section and a male member comprising a male mating section and a housing section. The male mating section is matingly received within the female mating section. The collar is positioned on the housing section. The collar is made up of a framework with a plurality of discrete bodies spaced about the framework and a portion of each of the discrete bodies protrudes above the framework.

27 Claims, 18 Drawing Sheets

(51) Int. Cl.
*E21B 17/00* (2006.01)
*E21B 4/02* (2006.01)

(56) References Cited

U.S. PATENT DOCUMENTS

| | | | |
|---|---|---|---|
| 7,487,840 | B2 | 2/2009 | Gammage et al. |
| 8,061,451 | B2 | 11/2011 | Salzer, III et al. |
| 8,511,377 | B2 | 8/2013 | Casassa et al. |
| 2003/0111269 | A1 | 6/2003 | Blair et al. |
| 2004/0157066 | A1 | 8/2004 | Arzoumanidis |
| 2007/0209839 | A1 | 9/2007 | Arnoldy |
| 2008/0047754 | A1 | 2/2008 | Evans et al. |
| 2008/0127475 | A1 | 6/2008 | Griffo |
| 2011/0203791 | A1 | 8/2011 | Jin et al. |
| 2011/0240370 | A1 | 10/2011 | Shwets et al. |
| 2012/0018227 | A1 | 1/2012 | Puzz et al. |
| 2012/0138369 | A1 | 6/2012 | Speer et al. |
| 2012/0325497 | A1 | 12/2012 | Kumar et al. |
| 2013/0192982 | A1 | 8/2013 | Watson et al. |
| 2013/0299243 | A1 | 11/2013 | Von Gynz-Rekowski et al. |
| 2015/0330155 | A1* | 11/2015 | Logan ..... E21B 17/003 166/380 |

FOREIGN PATENT DOCUMENTS

| | | | |
|---|---|---|---|
| WO | 0127434 | A2 | 4/2001 |
| WO | 03012247 | A1 | 2/2003 |
| WO | 2012012754 | A1 | 1/2012 |
| WO | 2013022733 | A2 | 2/2013 |
| WO | 2013032626 | A2 | 3/2013 |
| WO | 2013052546 | A1 | 4/2013 |
| WO | 2013170117 | A1 | 11/2013 |

* cited by examiner

MUD MOTOR WITH INTEGRATED ABRASION-RESISTANT STRUCTURE

CROSS-REFERENCE TO RELATED APPLICATIONS

This application claims priority from U.S. Application No. 61/830,524 filed 3 Jun. 2013. For purposes of the United States, this application claims the benefit under 35 U.S.C. §119 of U.S. Application No. 61/830,524 filed 3 Jun. 2013 and entitled MUD MOTOR WITH INTEGRATED ABRASION-RESISTANT STRUCTURE which is hereby incorporated herein by reference for all purposes.

FIELD

This disclosure relates mud motors as are used in drilling well bores, for example wellbores for extraction of petrochemicals. The disclosure relates more specifically to mud motors and protective enclosures for mud motors. Embodiments provide protective enclosures for mud motors and methods for fabricating such enclosures.

BACKGROUND

The recovery of hydrocarbons from subterranean zones relies on the process of drilling wellbores. This process includes drilling equipment situated at the surface and a drill string extending from the surface equipment to the formation or subterranean zone of interest. The drill string can extend thousands of feet or meters below the surface. The terminal end of the drill string includes a drill bit for drilling, or extending, the wellbore. The process also relies on some sort of drilling fluid system, in most cases a drilling "mud". The mud is pumped through the inside of the drill string, which cools and lubricates the drill bit and then exits the drill bit and carries rock cuttings back to the surface. The mud also helps control bottom hole pressure and prevents hydrocarbon influx from the formation into the wellbore and potential blow out at the surface.

In some drilling operations, a "mud motor" may be provided. Mud motors are commonly used to drive drill bits in directional drilling. A mud motor uses the flow of drilling fluid to generate rotary motion. This rotary motion may be used for driving a drill bit, for example.

The downhole environment in which a mud motor is used may be harsh. The outside of a mud motor may be subjected to wear through abrasion by materials carried in the drilling fluid, cavitation of the drilling fluid, friction or impacts with the sides of the wellbore and the like. Excessive abrasion can damage the mud motor or other components in a drill string. In extreme cases enough material can be worn away that the mud motor or other drill string component can become weak and fail (e.g. twist off or disconnect).

There is a need for alternative structures useful for protecting mud motors and other drill string components for protecting mud motors and other drill string components from wear and for wear-resistant mud motors and other drill string components.

SUMMARY

This invention has a number of aspects. One aspect provides constructions for housings for mud motors. Another aspect provides methods for fabricating housings for mud motors. Another aspect provides abrasion-resistant drill string components which may include but are not limited to mud motors.

One aspect provides a mud motor housing comprising a collar. The collar has a pair of longitudinal ends spaced apart from each other and a bore therethrough. The collar comprises a framework and a plurality of discrete bodies spaced about the framework. A portion of each of the plurality of discrete bodies may protrude radially outwardly from a surface of the framework. The framework and the plurality of discrete bodies extend between the longitudinal ends of the collar.

The framework may comprise one or more rings. In some embodiments, a plurality of rings has opposed side faces. Some or all of the plurality of discrete bodies may be received between side faces of adjacent ones of the rings.

The framework may comprise, for example, bodies made of a suitable metal or metal alloy. In some embodiments the framework comprises rings of beryllium copper for example The plurality of discrete bodies may be spheres. The spheres may comprise a wear-resistant material. The spheres may comprise a suitable grade of carbide, for example a tungsten-carbide or diamond-reinforced tungsten carbide material.

The collar may be maintained under longitudinal compression. Spaces in the collar may optionally be filled with a material such as an injected plastic, softer metal or the like.

According to a second aspect of the present disclosure, there is provided a housing for a mud motor. The housing comprises: a female member having a female mating section; a male member having a male mating section and a housing section, the male mating section being inserted into the female mating section whereby the male and female mating sections overlap; and a collar according to the first aspect of the present disclosure positioned on the housing section. The housing may comprise a stator configured to receive a rotor.

The housing section may be configured to interact with at least part of the protruding portion of the plurality of discrete bodies of the collar to impede rotation of the collar relative to the housing section. The housing section may comprise a plurality of longitudinally extending grooves on an external surface thereof and at least part of the protruding portion of the plurality of discrete bodies is received in one of the plurality of longitudinally extending grooves.

The male member may further comprise a shoulder section including a first annular shoulder. The collar may be positioned between the first annular shoulder and a second shoulder on the female mating section. The collar may be compressed between the first and second shoulders. The shoulders may be made of and/or faced with hard abrasion-resistant materials.

Another aspect provides a housing comprising: a first end comprising a first coupling and a second end. The first and second ends are attached to one another. A reduced-diameter section extends between and connects the first and second ends. A collar extends circumferentially around and along the reduced-diameter section. The collar comprises a plurality of rings, the plurality of rings are axially spaced apart from one another and radially spaced from the reduced-diameter section by bodies disposed between adjacent ones of the plurality of rings.

Another aspect provides a method for making a housing for a mud motor. The method comprises: placing a collar around a tubular portion; coupling the portion to at least one other part to yield an assembly wherein the collar is located between first and second shoulders; and axially compressing the collar.

Another aspect provides a housing for a mud motor comprising a male part comprising a bore having a first inner diameter, a normal section having a first outer diameter, a middle region having a second outer diameter less than the first outer diameter, and a male mating section coupled to a female part comprising a female mating section and a bore. The female mating section is configured to receive the male mating section. A collar surrounds the middle region of the male part.

Further aspects of the invention and features of a wide range of non-limiting embodiments of the invention are described below and/or illustrated in the drawings.

BRIEF DESCRIPTION OF THE FIGURES

The accompanying drawings illustrate non-limiting example embodiments of the invention.

DETAILED DESCRIPTION

The embodiments described herein generally relate to mud motors having protective housings and components of mud motors that include protective housings. The housings include collars. A collar may be provided by one or more members that extend circumferentially around a housing section. A plurality of discrete bodies may be interspaced between the circumferential members. In some embodiments the circumferential members comprise rings. In a non-limiting example embodiment the rings are metal rings and the discrete bodies comprise spheres of one or more very hard and tough materials such as tungsten carbide. The rings may be shaped to provide recesses to receive the discrete bodies.

The collar may be generally described as including a framework with a plurality of discrete bodies spaced within the framework. In some embodiments a portion of each of the discrete bodies protrudes radially outwardly past the framework. Either or both of the framework and the discrete bodies are made of wear-resistant material.

The collar is supported between two parts of the housing. In some embodiments the housing comprises a female member comprising a female mating section, a male member comprising a male mating section, and a housing section. The male mating section is matingly received within the female mating section. The collar is positioned on the housing section.

A suitable coupling (e.g. an API standard threaded coupling) for coupling the housing to a drill string) may be provided at one end of the housing. The coupling may be of a type that includes an internal seal.

Figure 1:
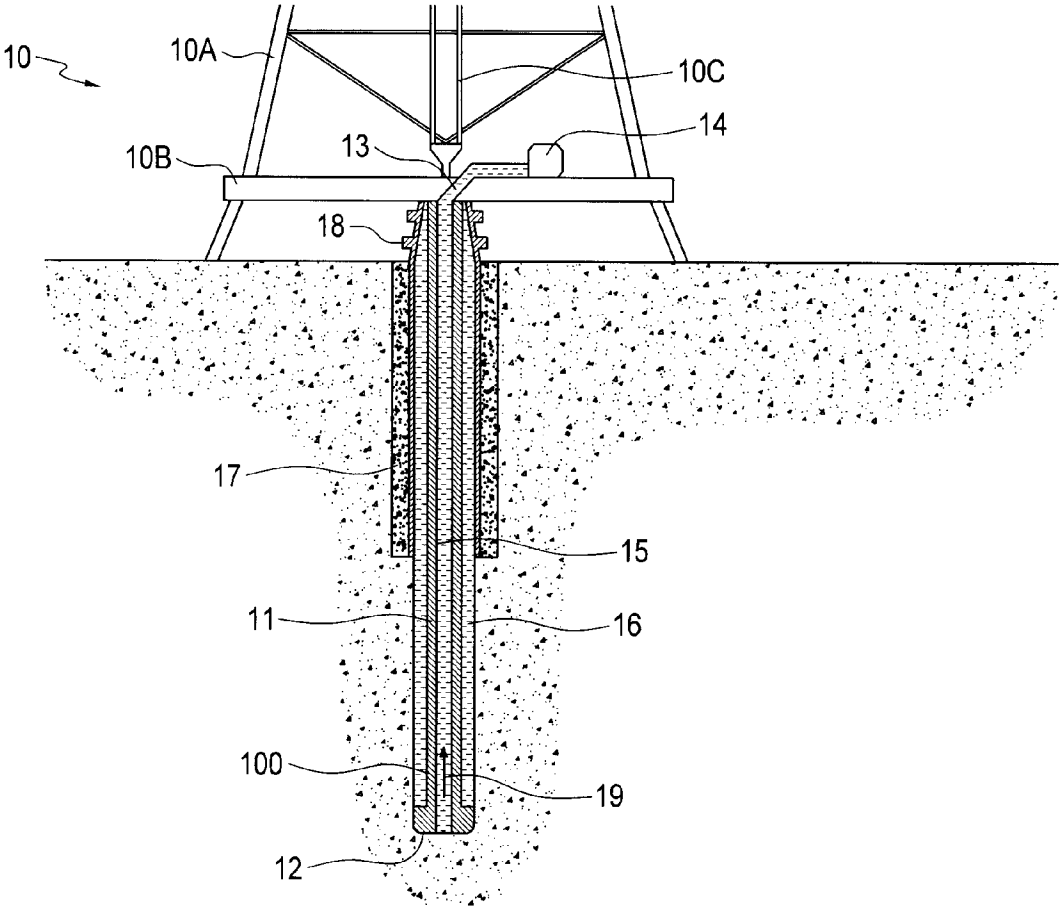
FIG. 1 is a schematic illustration showing an example drilling operation.

FIG. 1 shows schematically an example drilling operation. A drill rig 10 drives a drill string 11 which includes sections of drill pipe that extend to a drill bit 12. The illustrated drill rig 10 includes a derrick 10A, a rig floor 10B and draw works 10C for supporting the drill string. Drill bit 12 is typically larger in diameter than the drill string above the drill bit. Drilling fluid 13 is pumped by a pump 14 through a bore 15 in the drill string 11. Drilling fluid 13 returns to the surface through an annular region 16 surrounding drill string 11. Drilling fluid 13 may carry cuttings from the drilling operation. As the well is drilled, a casing 17 may be made in the well bore. A blow out preventer 18 is supported at a top end of casing 17.

A mud motor 19 is mounted at the downhole end of drill string 11. Mud motor 19 is configured to convert the flow of drilling fluid 13 through bore 15 into rotary motion. Mud motor 19 may be coupled to drill bit 12 to provide torque to drill bit 12. mud motor 19 is typically, but not always, mounted adjacent to drill bit 12.

Mud motor 19 comprises a housing 100. Housing 100 may comprise a stator of mud motor 19 or a separate protective structure that extends around the stator of mud motor 19. Housing 100 may be subject to wear due to contact with the sides of the wellbore, or due to cavitation caused by the flow of high pressure drilling fluid, or due to other factors. Housing 100 comprises features which resist wear and which protect mud motor 19. Mud motor housing 100 is one example of a housing that may be included in a drill string to which the principles described herein may be applied. Other examples of housings are bearing sections, adjustable housings, and power sections. Those of skill in the art will understand that structures as described herein may be applied to any drill string component having an exposed outer surface which it is desired to protect from abrasion.

Figure 2:
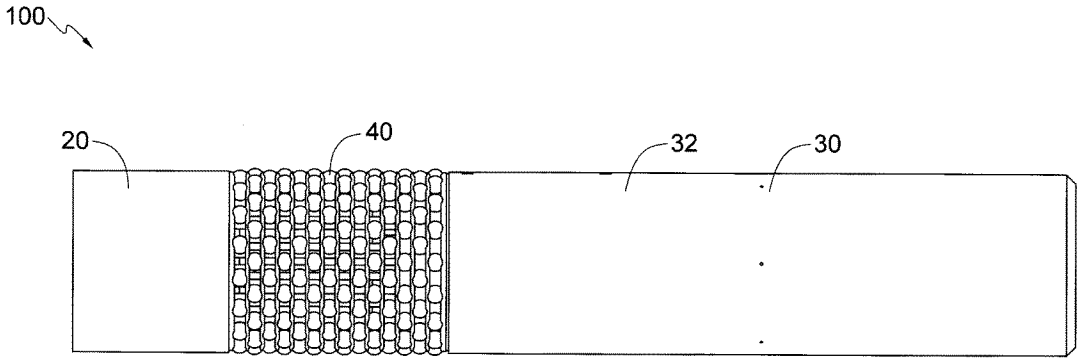
FIG. 2 is side view of a housing for a mud motor according to a first embodiment.
Figure 3:
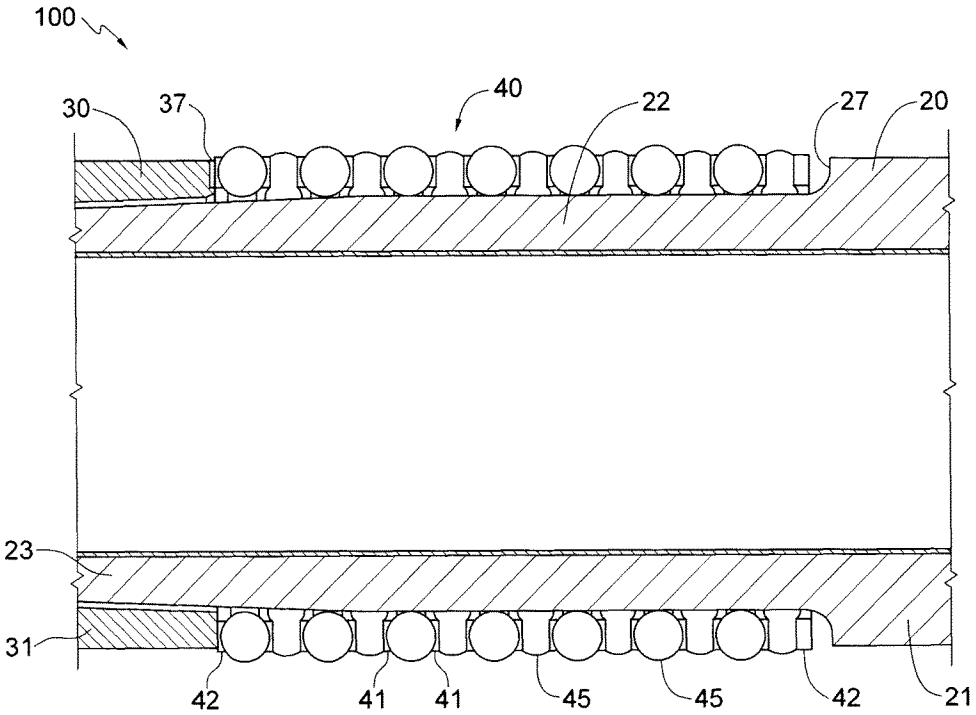
FIG. 3 is a cross sectional partial view of the housing of FIG. 2.

FIGS. 2 and 3 illustrate an example housing 100 in accordance with an example embodiment of the invention. Housing 100 includes a male member 20 mated with a female member 30 and a collar 40 positioned on the male member 20 between a first shoulder 27 on the male member and a second shoulder 37 on the female member. When housing 100 is coupled into drill string 11 as shown FIG. 1, female member 30 may be uphole and male member 20 may be downhole although this orientation is not mandatory.

Figure 4A:
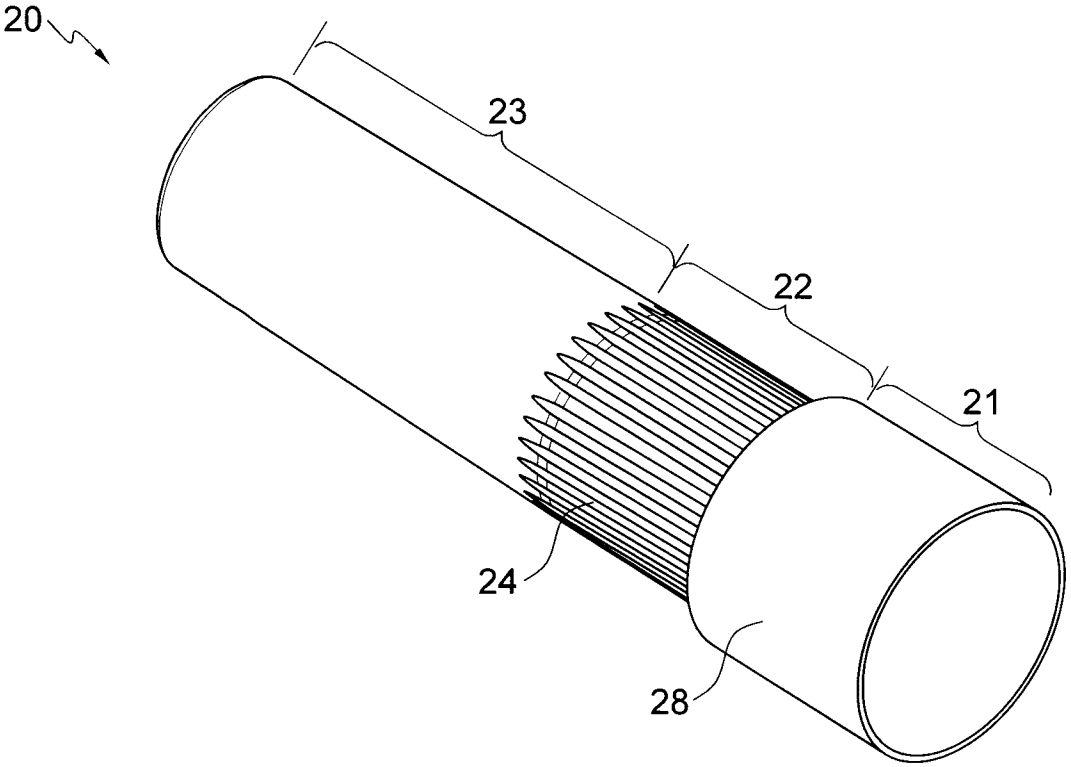
FIG. 4A is a perspective view and FIG. 4B is a side view of a male member of the housing of FIG. 2.
Figure 4B:
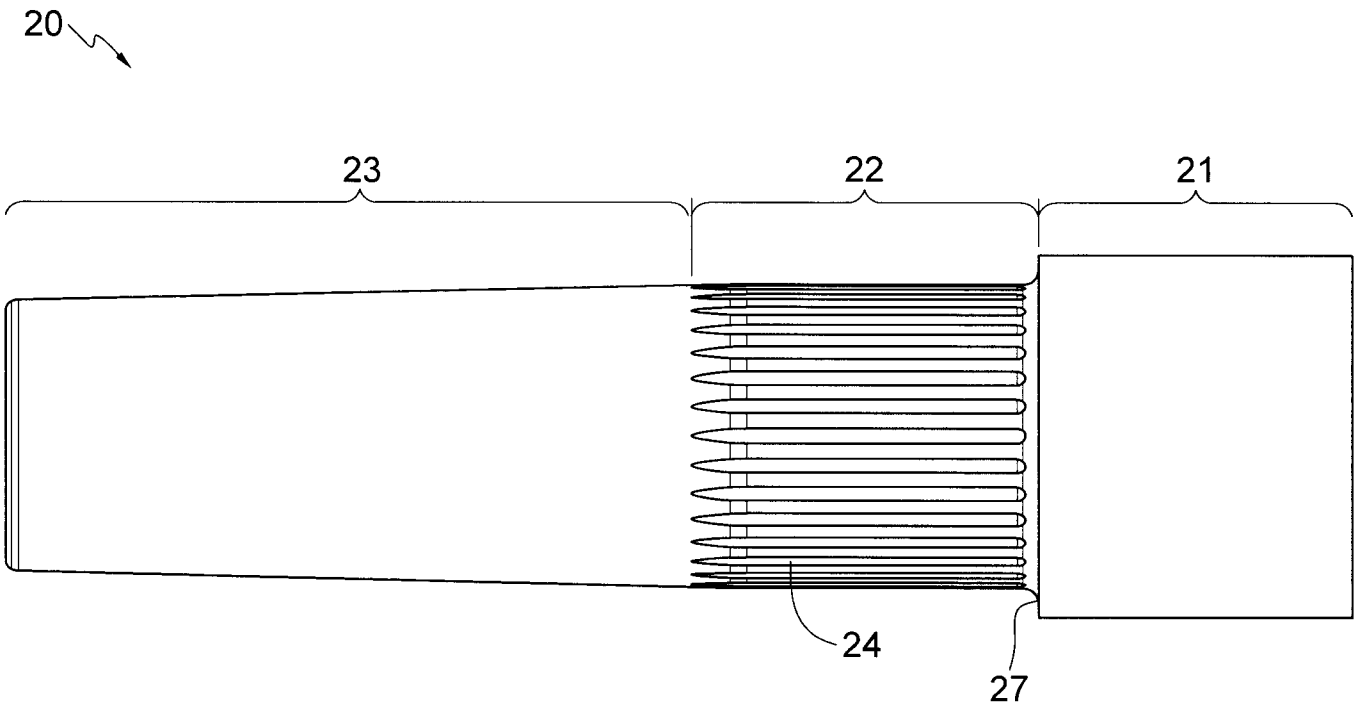
Figure 5:
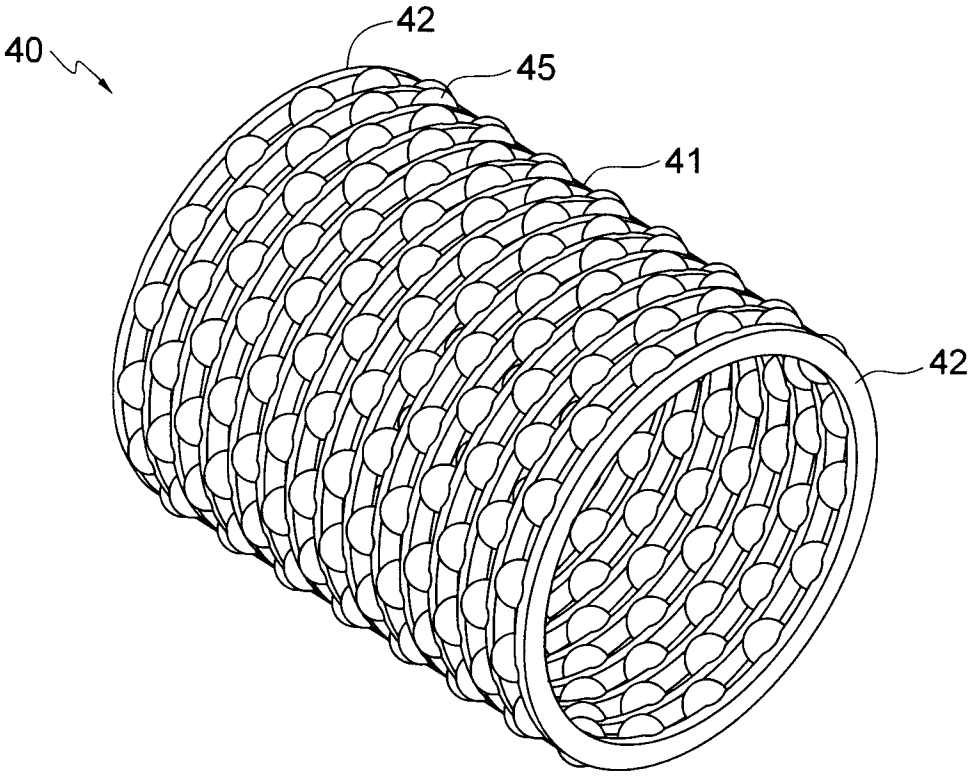
FIG. 5 is a perspective view of a collar of the housing of FIG. 2.
Figure 6:
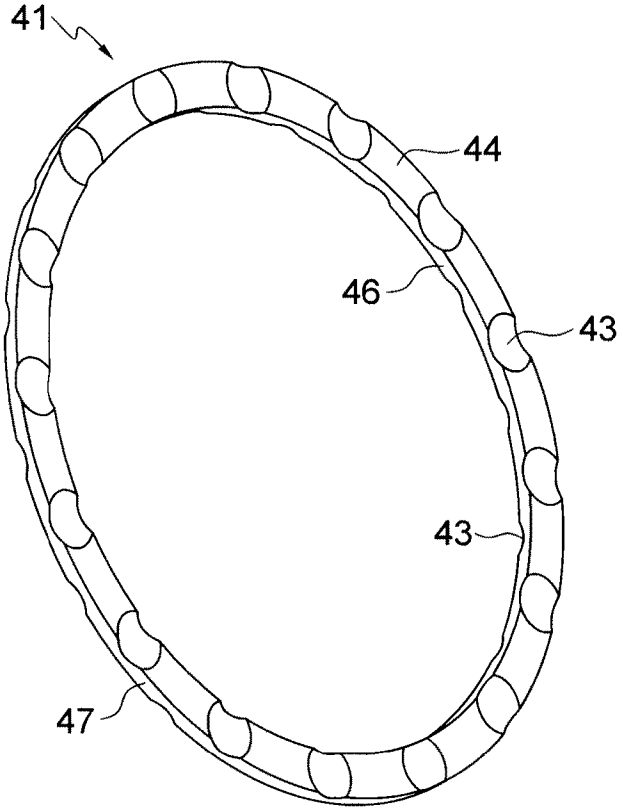
FIG. 6 is a perspective view of an internal ring of the collar of FIG. 5.
Figure 7:
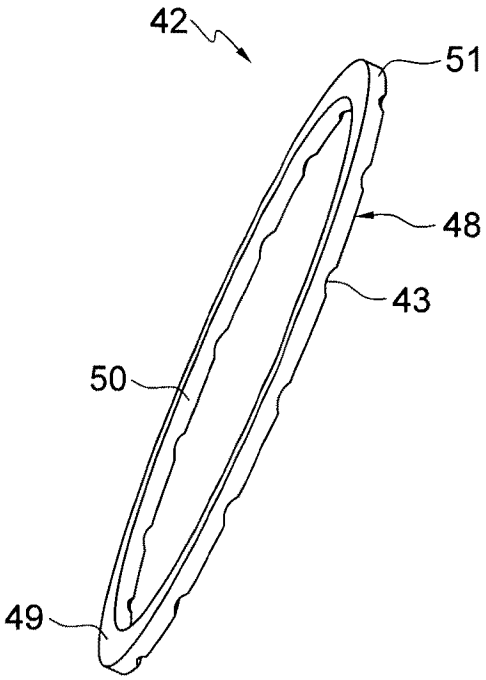
FIG. 7 is a perspective view of an end ring of the collar of FIG. 5.

As shown in FIGS. 4A and 4B, male member 20 comprises a body 28 with a bore therethrough. The outside of body 28 may be circular in cross-section. The inside of body 28 may be formed with stator features. A mud pump rotor (not shown in FIGS. 4A and 4B) may be supported in the bore of body 28. Interaction of flowing drilling fluid with the rotor and stator features causes the rotor to turn. The rotor may be coupled to drive drill bit 12.

Body 28 has a shoulder section 21, a housing section 22 and a mating section 23. Shoulder section 21 has a diameter greater than the diameters of housing section 22 and mating section 23, and forms part of the external surface of the housing 100 shown in FIG. 2. Shoulder section 21 includes an annular shoulder 27 adjacent to housing section 22.

Female member 30 comprises a body 32 with a bore therethrough. Body 32 may be circular in cross section. Body 32 has a mating section 31 configured to be mounted to mating section 23 of male member 20. Female member 30 may be mounted to male member 20 in any of a wide variety of ways. For example, mating section 31 of female member 30 may comprise threads that engage threads of mating section 23 of male member 20 or female member 30 may be welded to male member 20 or female member 30 may be pinned or bolted to male member 20 or the like.

In some embodiments, the internal surface of mating section 31 has a taper that corresponds to the taper of male mating section 23. The internal diameter of each part of female mating section 31 is greater than or equal to the external diameter of the corresponding part of male mating section 23 so that female mating section 31 fits over the male mating section 23 in the assembled housing 100 as shown in FIG. 3.

In alternative embodiments, the male and female mating sections may not be tapered. Additionally, or alternatively, other structures, for example, but not limited to grooves, threads or rings (not shown) may be included on the internal surface of the female mating section 31 and/or the external surface of the male mating section 23 to facilitate mating of the male and female members 20, 30.

Figure 16:
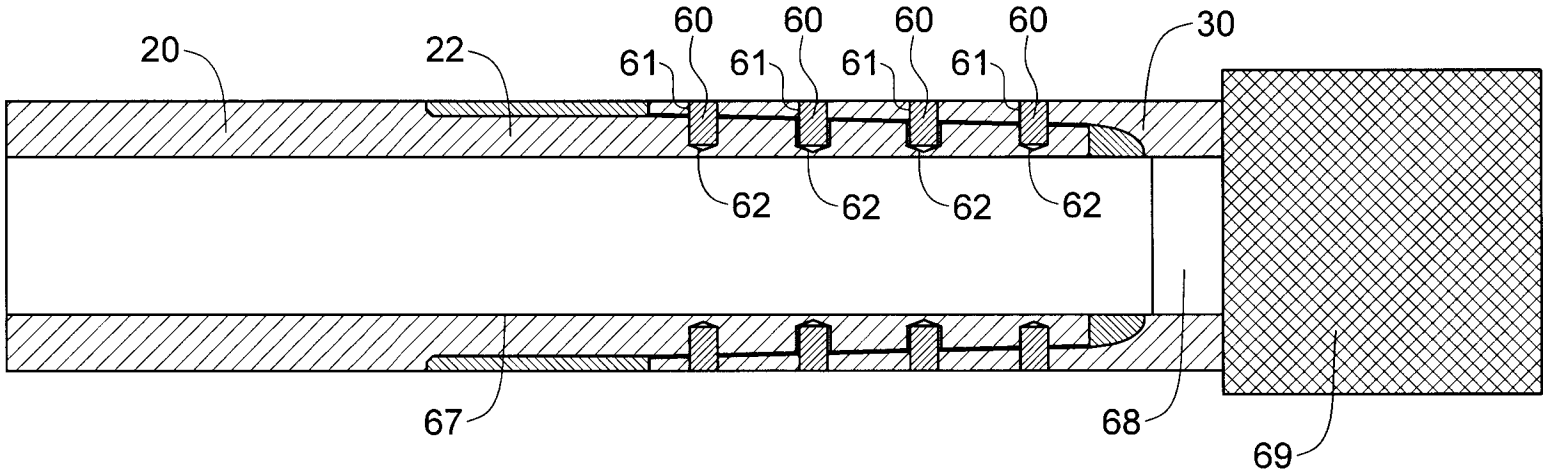
FIG. 16 is a cross sectional view of a pinned connection between a male and a female member according to an example embodiment.

As another example, male member 20 may be pinned to female member 30 using pins, bolts or the like. FIG. 16 shows an example of a pinned connection between male member 20 and female member 30. In this example, pins 60 are inserted through apertures 61 in female member 30 and into corresponding bores 62 in male member 20. Pins 60 may be fixed within apertures 61 and bores 62 by a friction fit, by a threaded connection, by epoxy, or by any other suitable means. The number of pins and their locations may be varied. Pins 60 may be spaced apart around the circumferences of male member 20 and female member 30.

FIG. 3 shows a male member 20 and female member 30 in mating relationship. Collar 40 is positioned on the housing section 22 between a first annular shoulder 37 on one end of the female mating section 31 and a second annular shoulder 27. In some embodiments, collar 40 is compressed between shoulders 27 and 37. In some embodiments, collar 40 is compressed with a pressure of between 500 psi and 8000 psi. Collar 40 may be rigid under compression such that the interaction between collar 40 and shoulders 27 and 37 stiffens housing 100 against bending. This construction tends to prevent or reduce flexure of housing 100 by transmitting mechanical loads resulting from flexing of housing 100 into shoulders 27, 37.

FIGS. 5 to 9 show an example collar 40 comprising a plurality of internal rings 41 positioned between two end rings 42. A plurality of discrete bodies, which in the embodiment shown in FIGS. 5 to 9 are spheres 45, are seated between adjacent rings 41, 42. In one embodiment, rings 41, 42 are made of a metal or metal alloy, for example, but not limited to, copper, copper alloys (e.g. beryllium copper), inconel or stainless steel. In such embodiments spheres 45 are made of a wear-resistant material, for example, but not limited to, metals, composites, hard tough ceramics or carbides, diamonds, diamond-impregnated composite materials, sintered bodies of hard materials, or the like.

Internal rings 41 have two opposed side faces 44 extending between an internal face 46 and an opposed external face 47. End rings 42 have an inner side face 48 and an opposed outer side face 49 spaced between an internal face 50 and an external face 51. In the embodiment shown, the end ring internal and external faces 50, 51 are thicker than the internal and external faces 46, 47 of internal rings 41.

Figure 15:
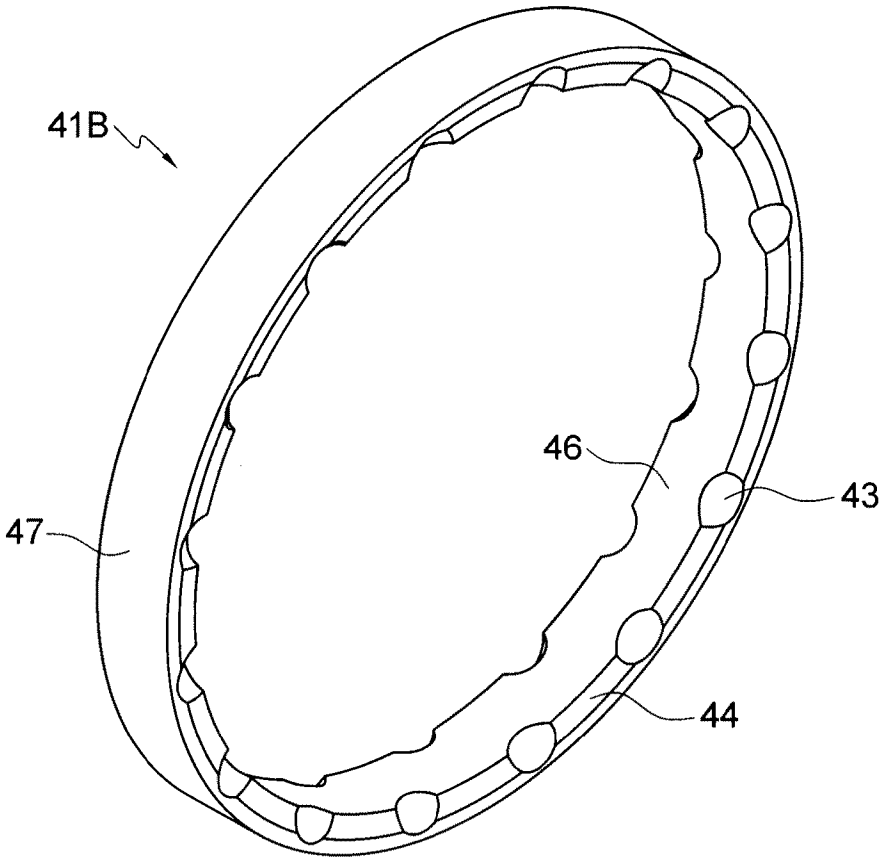
FIG. 15 is a perspective view of an internal ring of a collar according to an example embodiment.

FIG. 15 illustrates a ring 41*b* according to an alternative design. Ring 41*b* is similar to rings 41 except that it is tapered in thickness such that outer parts of ring 41*b* close to external face 47 are thicker than inner parts of ring 41*b* closer to internal face 46. In some embodiments ring 41*b* tapers to an edge at which side faces 44 meet. In such embodiments internal face 46 may be very narrow. A greater thickness to the end ring internal and external faces 50, 51 may provide structural stability to the collar 40.

In alternative embodiments (not shown) the internal ring internal and external faces 46, 47 may be the same thickness as the end ring internal and external faces 50, 51, or the internal ring internal and external faces 46, 47 may be thicker than the end ring internal and external faces 50, 51 or the rings 41, 42 may be of varying size, shape, and placement for various structural requirements.

In some embodiments, rings 41 and 42 trap spheres 45 or other discrete bodies against male member 20. This is accomplished in some embodiments by making side faces 44 of rings 41 beveled. In some embodiment side faces 44 have pockets for receiving spheres 45 or other bodies.

Figure 15B:
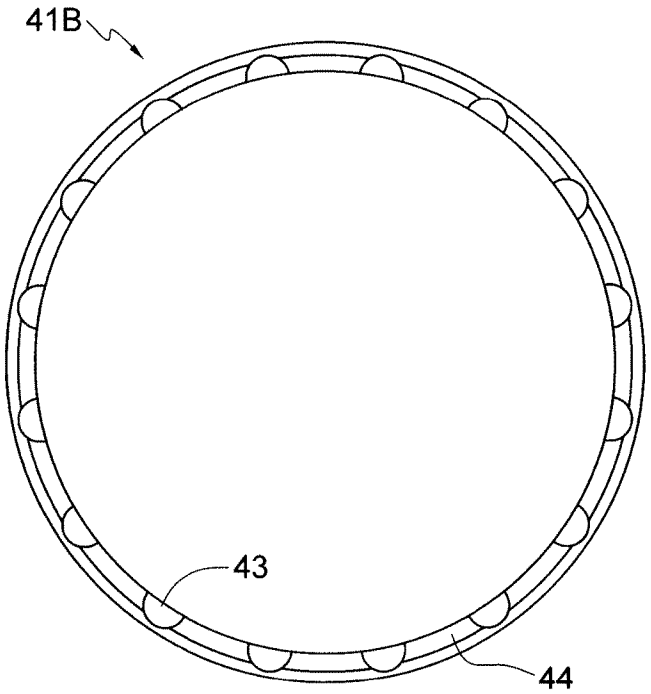
FIGS. 15A and 15B are front and back views of the internal ring of FIG. 15.
Figure 15A:
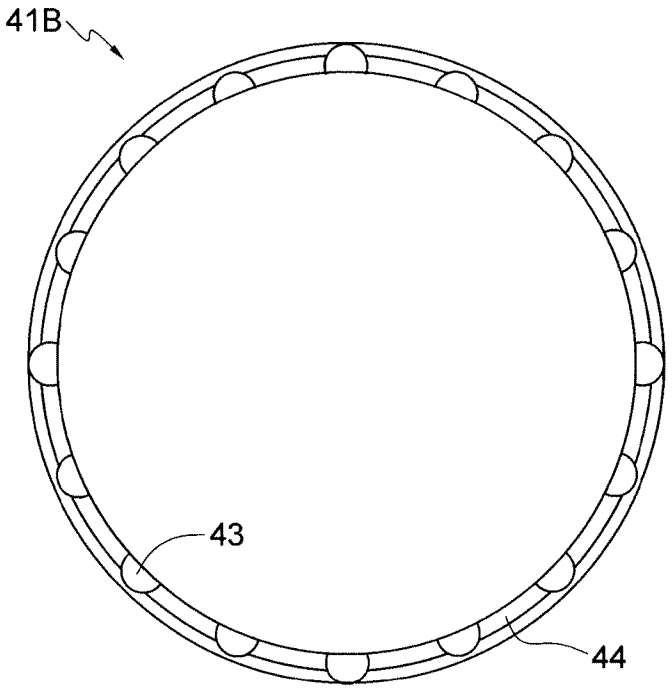

In the embodiments illustrated in FIGS. 15A and 15B, side faces 44 of the internal rings 41 have a plurality of surface depressions or dimples 43 spaced around their surfaces. Dimples 43 on one side face 44A of each internal ring 41 are offset with the dimples 43 on the opposed side face 44B. More spheres 45 can be included in the collar 40 when the internal rings 41 are thinner. This may increase the wear resistance of collar 40 as will be discussed in more detail below.

The inner side face 48 of each of the end rings 42 also has a plurality of dimples 43 spaced around the surface thereof. The outer side face 49 may be smooth so that it can butt against the male or female shoulder 27, 37. It is not necessary for there to be dimples 43 in outer side face 49.

Collar 40 may be assembled on the housing section 22 before mating the male and female members 20, 30 together. One of end rings 42 is placed over housing section 22 and positioned with its outer side face 49 adjacent to male shoulder 27. Internal rings 41 are then stacked onto the housing section 22 followed by the other end ring 42 with its inner side face 48 facing the side face 44 of the adjacent internal ring 41.

Rings 41, 42 are positioned such that the dimples 43 of adjacently facing internal ring side faces 44 are aligned and the dimples 43 of the end ring inner side faces 48 and the adjacently facing internal ring side face 44 are aligned.

Spheres 45 are positioned between the rings 41, 42 and sit in the aligned dimples 43. The profile of the dimples 43 correspond to the curved profiles of spheres 45, thereby securing each sphere 45 between the side faces 44, 48 in the assembled collar 40.

Alternatively, the stacked rings 41, 42 and spheres 45 may be assembled to form collar 40 before positioning the collar 40 onto housing section 22.

The outer surface of male member 20 may include recesses such as dimples, holes or grooves that receive spheres 45. For example, housing section 22 may have a plurality of longitudinally extending grooves 24 spaced around the circumference of the external surface of housing section 22. The number of grooves 24 is dictated by the design of the collar 40 as will be discussed in detail below. The geometry of the grooves 24 (depth, placement, profile, length, etc.) is a function of the geometry of the collar 40 and housing section 22. The sides of spheres 45 facing toward housing section 22 may be received in grooves 24.

Collar 40 (or alternative collar 240 discussed below) may be positioned on housing section 22 such that each of spheres 45 sits in one of longitudinal grooves 24 of housing section 22. In the embodiments shown in FIGS. 4A and 4B, there are thirty two grooves 24 spaced around the circumference of the housing section 22. This allows for spheres 45 in each of the offset layers of the collar 40 shown in FIG. 5 to be received in one of grooves 24. In alternative embodiments (not shown), the number of grooves 24 may vary. This number of grooves 24 provided in a specific embodiment may depend on the number of spheres 45 in each layer and the offset arrangement of the collar layers. For example, a collar made up of the rings 41*a*, 42 of FIG. 10 may have sixteen spheres 45 in each layer, however the layers are not offset, therefore only sixteen grooves 24 need to be present on the housing section to receive each sphere 45. Positioning of the spheres 45 in the longitudinal grooves 24 locks collar 40 (or 140, 240) in place. This beneficially prevents rotation or torsional movement of the collar 40, 140, 240 and thereby may increase the torsional strength of housing section 22.

Dimples 43 may be uniformly spaced around rings 41. Grooves 24 may be uniformly spaced around the circumference of housing section 22.

The spacing of the dimples 43 around the side faces 44 of the internal rings 41 and the inner side face 48 of the end rings 42 is such that there are gaps between the spheres 45 seated in the dimples 43. In some embodiments (not shown) the spheres may be tightly packed so that there are no gaps between them.

In the embodiments shown in FIGS. 5 to 9 rings 41 and 42 have sixteen dimples 43 uniformly spaced around each of the internal ring side faces 44 and each of the end ring inner side faces 48. Sixteen spheres 45 are therefore seated between a pair of adjacent rings 41, 42, which make up one layer of the collar 40. The spheres 45 of each layer have an angular spacing of Y degrees.

In the embodiments shown in FIGS. 5 to 9, spheres 45 project inwardly towards the centres of rings 41 and thereby space apart rings 41 from housing section 22. In other embodiments (not show), the internal diameters of rings 41 are equal to the external diameter of housing section 22, and thus rings 41 are directly supported by housing section 22. In some such embodiments, dimples 43 may be positioned on rings 41 such that spheres 45 contact housing section 22. In some such embodiments, dimples 43 may be positioned on rings 41 such that spheres 45 are spaced apart from housing section 22.

Figure 9:
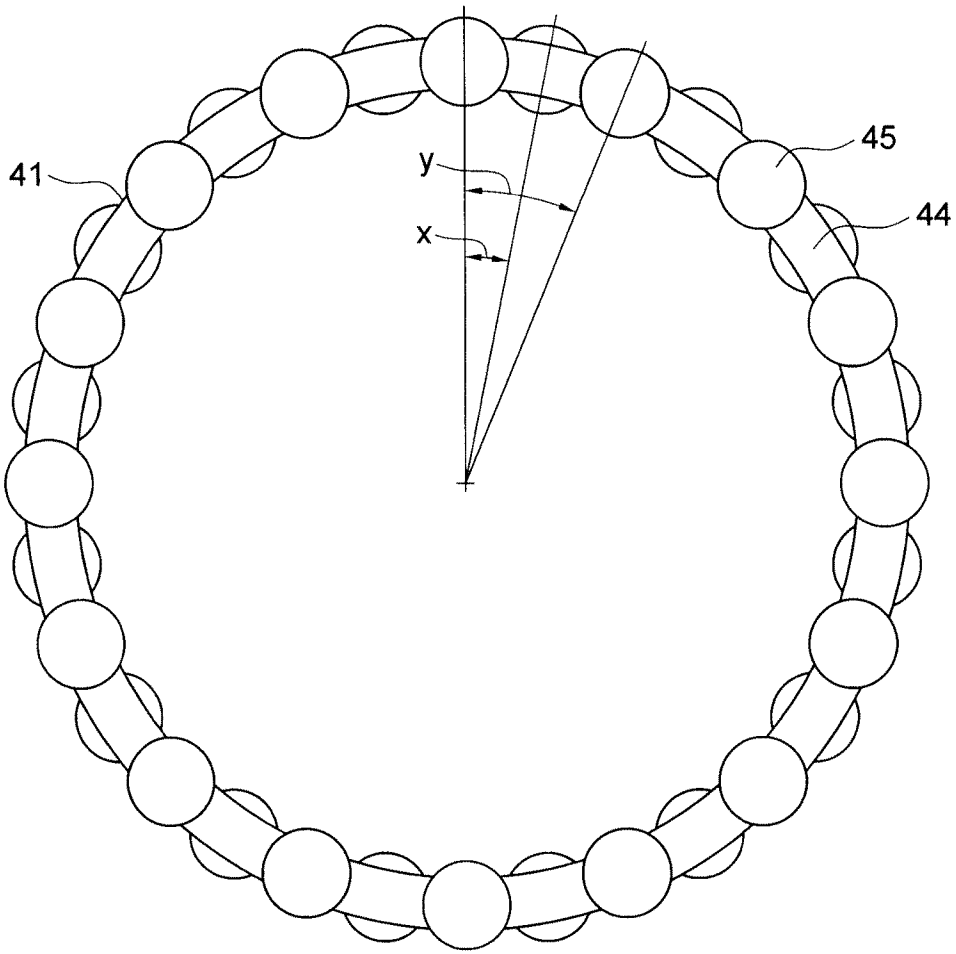
FIG. 9 is a face view of an internal ring of the collar of FIG. 5 showing spheres seated in surface depressions on opposed side faces of the internal ring.

In the exemplary embodiment shown in FIG. 9, there are sixteen spheres 45 and Y is 22.5 degrees. As a result of offsetting of the dimples 45 of opposed side faces 44 of each of the internal rings 41, the spheres of two adjacent layers are also angularly offset. The angular offset of spheres 45 in adjacent layers is X degrees. In the exemplary embodiment shown in FIG. 9, X is one half the angle of the radial spacing of the spheres 45 in the adjacent layer, therefore X is 11.25 degrees. The spheres 45 of each layer are therefore located in alternating fashion when viewed longitudinally along the collar 40, with alignment of the spheres 45 of layers 1, 3, 5 etc. and alignment of the spheres 45 of layers 2, 4, 6 etc.

In an alternative embodiment as shown in FIGS. 13 and 14A-C, the outer side face 49*a* of end rings 42*a* of collar 40*a* include spaced dimples 43 and corresponding aligning dimples 43 are included on the surfaces of male and female shoulders 27*a*, 37*a* of male and female members 20*a*, 30*a* respectively. The dimples 43 on the male shoulder 27*a* align with the longitudinal grooves 24*a* of the housing section 22*a*. Spheres 45 are positioned between the end rings 42*a* and the male and female shoulders 27*a*, 37*a*. In an alternative embodiment (not shown) only one of the end rings 42*a* and one of the corresponding male or female shoulders 27*a*, 37*a* may have dimples 43 thereon for positioning of spheres 45 therein.

The dimples 43 of the outer side face 49*a* of each end ring 42*a* are offset from the dimples 43 on the inner side face 48*a* of that end ring 42*a*, so that the spheres 45 positioned between the outer side faces 49*a* and the male and female shoulders 27*a*, 37*a* are offset from the spheres 45 in adjacent layers of collar 40*a*. In an alternative embodiment (not shown) the dimples 43 on the outer side face 49*a* of each end ring 42*a* align back to back with the dimples 43 on the inner side face 48*a* of that end ring 42*a*.

In alternative embodiments (not shown) the number of spheres 45 in each layer may be more or less than sixteen depending on the size of the rings 41, 42, the size of the spheres 45 and the spacing between each sphere 45. Furthermore, the spacing of the dimples 43, and thus the spheres 45, may be random rather than uniform. Furthermore, in an alternative embodiment (not shown), the radial offset X of spheres 45 of adjacent layers of the collar 40 may be more than or less than half the radial spacing Y between the spheres 45. For example X may be one third of Y so that spheres of the $1^{st}$, $4^{th}$, $7^{th}$ layer etc. align, spheres of the $2^{nd}$, $5^{th}$, $8^{th}$ layer etc. align, and spheres of the $3^{rd}$, $6^{th}$, $9^{th}$ layers etc. align. Alternative embodiments (not shown) may use a different pattern of radial spacing of spheres 45. Other innovative aspects of the invention apply equally in embodiments such as these.

Figure 10C:
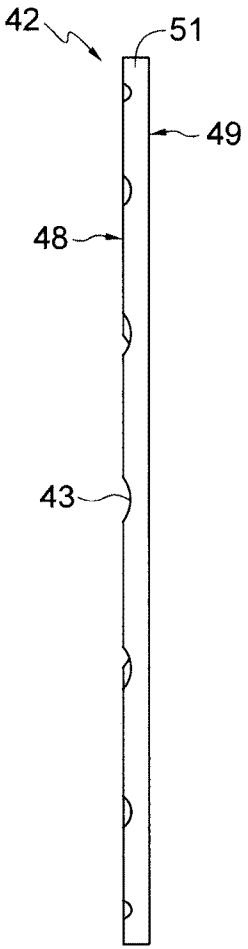
FIGS. 10A, 10B and 10C are side views of an end ring, internal ring and the other end ring respectively according an alternative embodiment of the collar.
Figure 10B:
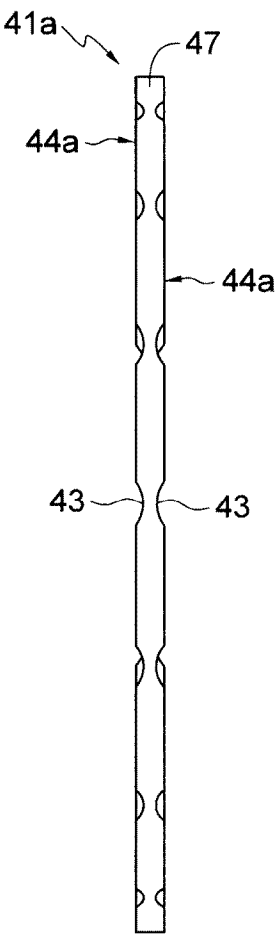
Figure 10A:
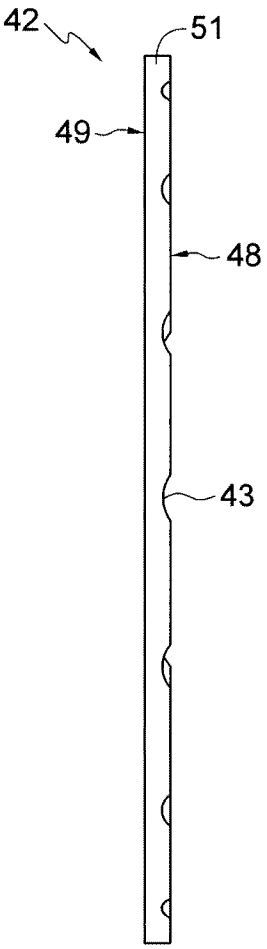

In an alternative embodiment shown in FIG. 10, the internal ring 41*a* has dimples 43 in back to back alignment on each opposed side faces 44*a* of the internal ring 41*a*, such that spheres 45 positioned between the internal and end rings 41*a*, 42 will be aligned rather than offset. Alignment of spheres 45 back to back may beneficially transmit stresses more readily for specific drilling applications and may provide structural strength and stiffness to the collar, which may be important when there are high stresses on the housing.

As discussed above with regards to the embodiment shown in FIGS. 5 to 9, the end rings 42 of this alternative embodiment may optionally include dimples 43 on the outer side face 49, such that spheres 45 can be positioned between the end rings 42 and the male and female shoulders 27, 37.

The dimples 43 of the outer side face 49 of the end rings 42 may align back to back or may be offset from the dimples 43 on the inner side face 48 of the end rings 42 in this alternative embodiment.

Figure 8C:
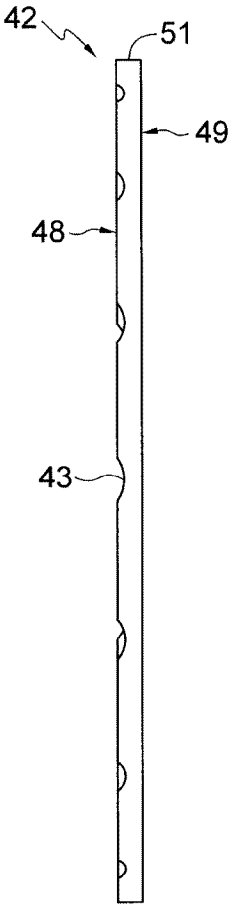
FIGS. 8A, 8B and 8C are side views of the end ring, internal ring and the other end ring respectively of the collar of FIG. 5.
Figure 8B:
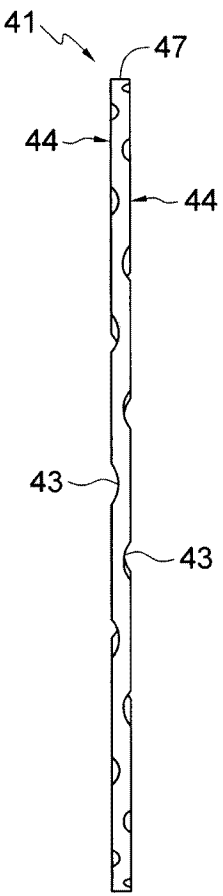
Figure 8A:
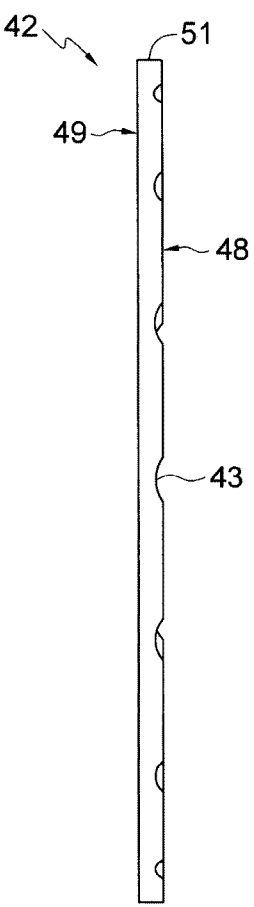
Figure 11:
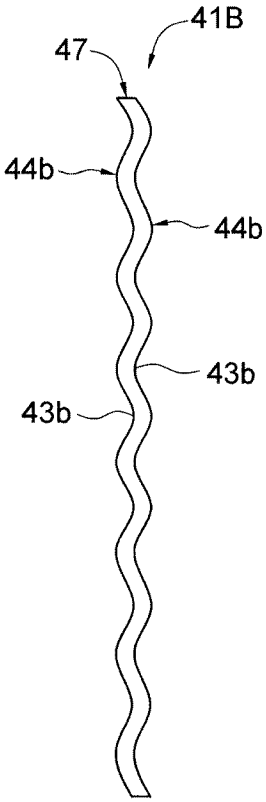
FIG. 11 is a side view of an internal ring according to an alternative embodiment of the collar.

In a further alternative embodiment shown in FIG. 11, an internal ring 41*b* has undulating side faces 44*b* and surface depressions 43*b* are provided as a result of the undulating side faces 44*b*. The surface depressions 43*b* are offset on opposed side faces 44*b* of the internal ring 41*b*. The end rings may also be undulating (not shown) and spheres 45 may be positioned between the surface depressions of the outer side face of the end rings and the male and female shoulders 27, 37. Alternatively, the end rings may be as shown in FIGS. 8 and 10.

It is evident from the foregoing that while the embodiments shown in FIGS. 5 to 11 utilize spheres 45 and dimples 43 or surface depressions 43*b* with a curved profile, in alternative embodiments differently-shaped discrete bodies, such as cuboids, cube, cylinder or egg shaped bodies may be used. In these alternative embodiments the profile of the dimples 43 or surface depressions 43*b* on the internal ring side faces 44, 44*a*, 44*b* and the end ring inner side faces 48 (and optionally the end ring outer side faces 49) may correspond with the profile of the discrete bodies so that the discrete bodies are securely seated between the side faces 44, 44*a*, 44*b*, 48, 49.

Furthermore, in alternative embodiments there may be no dimples 43 on the ring faces 44, 41*a*, 48, 49 and the discrete bodies may be secured between the rings 41, 41*a*, 42 in some other way, for example using an adhesive or another structural feature such as a protrusion from the surface of the rings (not shown). Other innovative aspects of the invention apply equally in embodiments such as these.

It can be desirable to apply compressive pre-load to collar 40. Such preloading may be achieved in various ways.

One way to apply compressive preloading to collar 40 is to insert wedges or the like (not shown) between one or both of shoulders 27, 37 and the outer side face 49 of the adjacent end rings 42.

Another way to apply compressive pre-loading to collar 40 is to press or pull on male and female members 20, 30 so as to force male shoulder 27 toward female shoulder 37 before mating male and female members 20, 30 to one another.

Another way to apply compressive pre-loading to collar 40 is to provide a threaded coupling between male and female members 20, 30. The threaded coupling may permit drawing male shoulder 27 toward female shoulder 37 by turning male member 20 relative to female member 30. By way of non-limiting example, the threaded coupling may comprise threads directly formed in female member 30 and male member 20, helical grooves formed on an outside diameter of mating section 23 of male member 20 and corresponding helical grooves formed on an inside diameter of mating section 31 of female member 30, or the like.

Another way to apply compressive loading to collar 40 is to provide high strength rods or cords that extend across housing section 22 (for example between rings 41, 42 and male member 20) and can be tightened to draw shoulders 27, 37 toward one another.

Another way to apply compressive loading to collar 40 is to provide a member adjacent to shoulder 27 that has internal threads that engage corresponding threads on the outer diameter of male member 20 at the end of housing section 22 adjacent to shoulder section 21. The member may be turned relative to male member 20 so that it advances toward shoulder 37 to compress collar 40. In an alternative embodiment a threaded member is adjacent shoulder 37 and can be turned to compress collar 40 against shoulder 27.

Another way to apply compressive loading to collar 40 is to provide a member adjacent to shoulder 27 or 37 that can be forced toward the opposing shoulder 37 or 27 by way of suitable cams, wedges, bolts or the like.

Once collar 40 is positioned on the housing section 22 female member 30 can be mated with male member 20 to form housing 100. Where collar 40 will be compressively pre-loaded. Depending on the mechanism for applying the pre-loading, the preloading may be performed before, after or as part of mating male section 20 to female section 20.

Providing a collar 40 that is compressed can increase resistance of housing 100 to bending. Essentially, collar 40 may carry forces between shoulders 27 and 37 thereby resisting bending. Collar 40 functions in place of solid material that would be present in a section of drill string lacking a housing. A housing which includes a collar 40 may approximate the resistance to bending of an equivalent section of solid material. In some embodiments, the section of drill string having collar 40 has a Young's modulus which is at least 100%, 99%, 95%, 90%, 80%, 70%, or 50% of the Young's modulus of an equivalent section of drill string that does not have a housing section. Stiffness of the housing 100 carrying collar 40 may be increased by increased preloading, increased number of discrete bodies, and/or using discrete bodies shaped to provide increased contact area with rings of collar 40 for example. An equivalent section of solid material may comprise a housing with the same material, outer diameter and bore diameter as housing 100 but made of solid metal.

In some embodiments compressive forces applied to collar 40 are transmitted by way of a ring and the points at which forces are applied to one side face of the ring are angularly offset relative to the points at which forces are applied to the opposing side face of the ring. These forces can therefore cause some bending of the ring which may act as a stiff spring, In such embodiments, forces which attempt to bend the housing will attempt to further compress collar 40 along one side of the housing. Collar 40 can resist such further compression thereby stiffening the housing against bending. Collar 40 may be made to have a desired stiffness by selecting the construction of the rings, the material of the rings, the width of the rings, the thickness of the rings, the ring geometry, and/or the number and composition of spheres 45 or other discrete bodies spaced around the rings. Stiffness may be increased by increasing the number of spheres 45 in each layer of collar 40 (all other factors being equal).

A mud motor 67 is mounted within housing 100. Mud motor 67 is connected by a shaft 68 to drive a drill bit 69.

The number of internal rings 41, 41*a*, 41*b* can be varied depending on the size of the housing 100, which beneficially allows collar 40 to be designed to fit any sized housing.

Advantageously, rings 41, 42 may be made of or have their external faces 47, 51 coated with or formed of a hard wear-resistant metal. The material of rings 41, 42 is preferably not so brittle that rings 41 or 42 will break under expected operating conditions.

Voids between rings 41, 42, male and female members 20, 30 and discrete bodies 45 may optionally be filled with materials suitable for downhole conditions. The materials may comprise, for example, injectable plastics, metals having lower melting points than the other components (e.g. solders, brazing materials), impregnated resins, curable resins and the like. Rings 41, 42, especially where tapered to provide undercut edges can protect the material filling these voids against tear out. In some embodiments, the voids are left unfilled.

As shown for example in FIG. 11, in some embodiments, rings 41, 42 may have undulating side faces. Even rings which do not have undulating side faces, may deform as a result of axial compression of collar 40 so that their side faces undulate to some degree. Rings may optionally be machined to provide undulating side faces.

Figure 17:
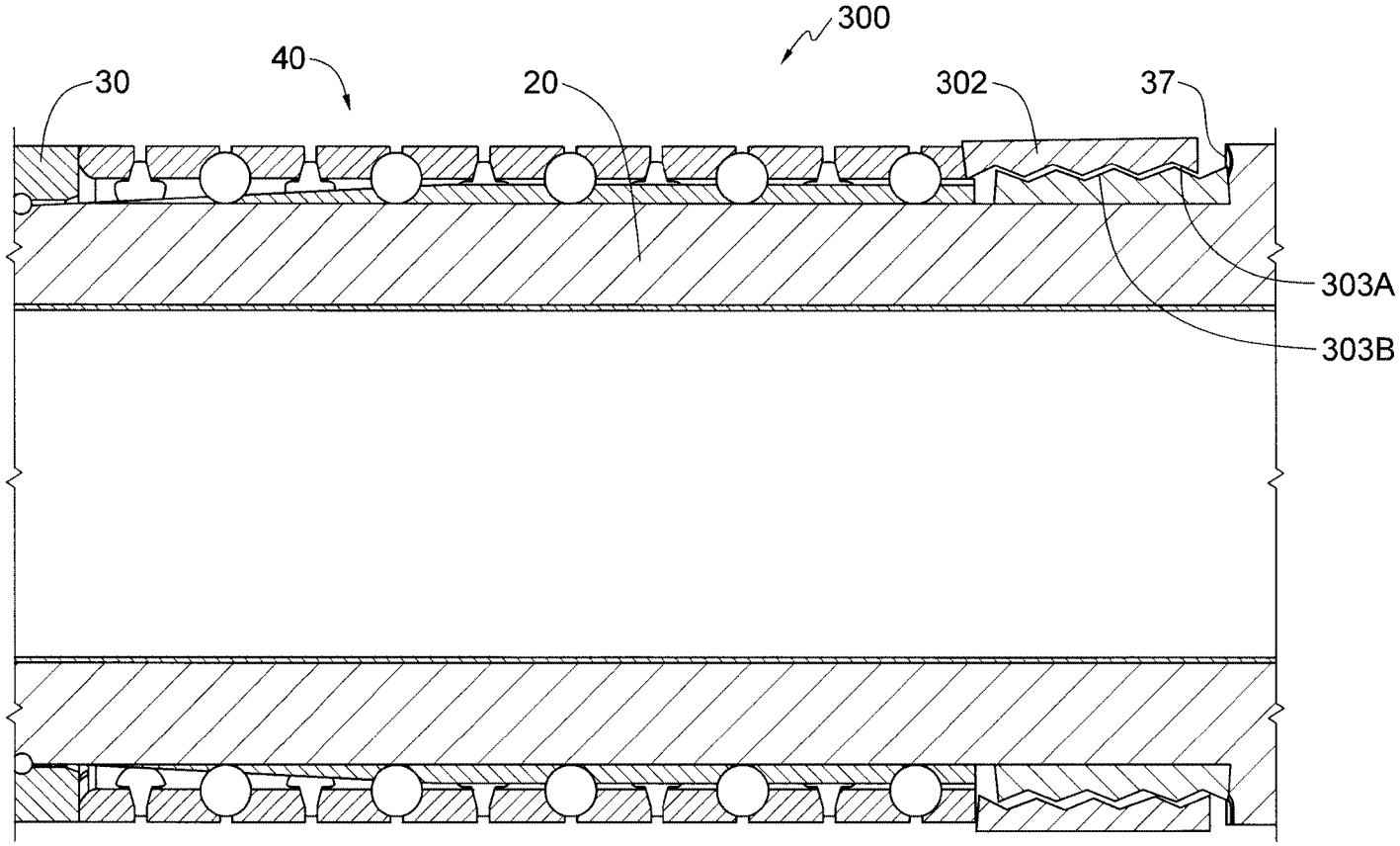
FIG. 17 is a cross section view of a connection between a male and a female member with a compression collar.

FIG. 17 illustrates a housing 300 according to a still further example embodiment. For clarity, no mud motor is shown within housing 100. Housing 300 comprises a male part 20 and a female part 30 which may be substantially as described above. A collar 40 is supported between shoulders 27, 37. An axially-movable compression collar 302 is mounted on male part 20 adjacent to collar 40. Compression collar 40 may be moved to apply compressive preload to collar 40.

In the illustrated embodiment, compression collar 302 has internal threads 303A that engage threads 303B on male part 20. In this embodiment, compression collar 302 may be advanced toward shoulder 27 by turning compression collar 302 relative to male part 20.

Figure 12:
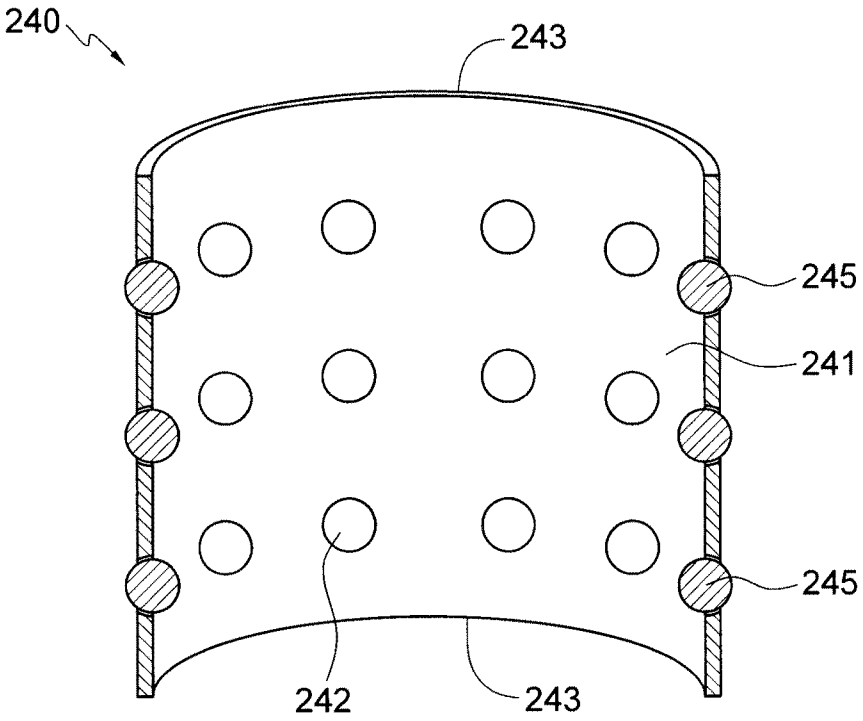
FIG. 12 is a cross sectional cut view of a collar according to an alternative embodiment.
Figure 13:
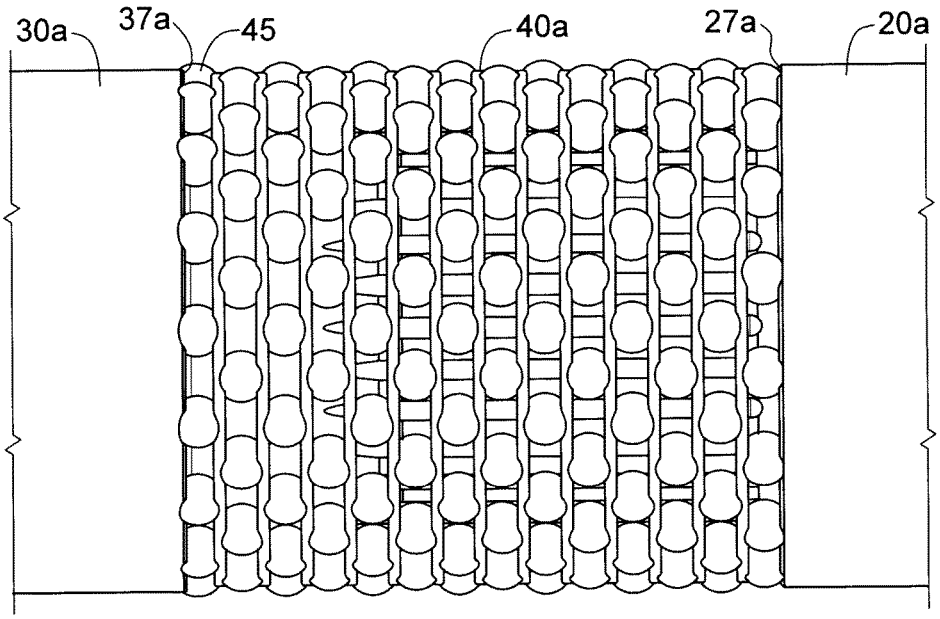
FIG. 13 is a cross sectional partial view of a housing according to a second embodiment.
Figure 14A:
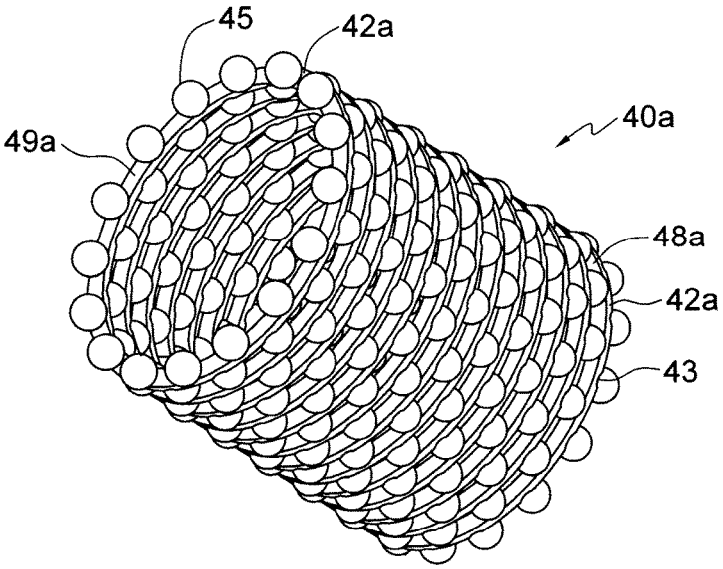
FIGS. 14A, 14B, and 14C are a perspective view of a collar, a perspective partial view of a female member, and a perspective partial view of a male member respectively of the housing of FIG. 13.
Figure 14B:
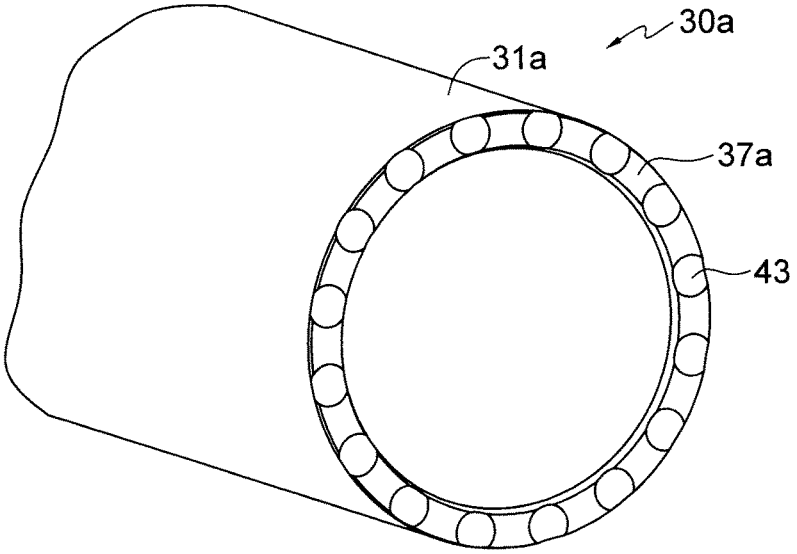
Figure 14C:
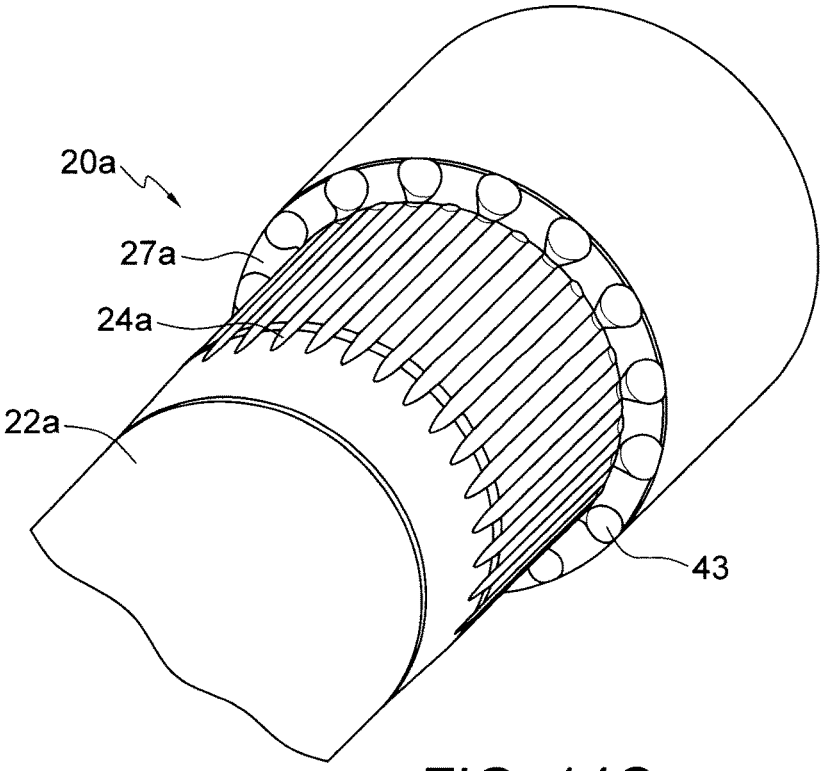

FIG. 12 shows a collar 240 in accordance with another example embodiment of the invention. Collar 240 comprises a cylindrical sleeve 241 including a plurality of holes 242 therethrough which are configured to receive a plurality of spheres 45. Spheres 45 may be optionally secured in the holes 242 by an adhesive.

In the embodiment shown in FIG. 12, the discrete bodies are spheres 45, however in alternative embodiments the discrete bodies may be of a different geometrical shape, for example, but not limited to, cuboids, cube, cylinder or egg shaped bodies and the holes 242 are shaped to receive the different shaped discrete bodies. In an alternative embodiment (not shown) the holes 242 may have a smaller cross-sectional area than the largest cross-sectional area of the discrete bodies such that only a portion of the discrete body protrudes through the hole. In this embodiment the widest part of the discrete body is positioned between the housing section 22 and the sleeve 241, therefore the discrete bodies cannot pass through the holes 242. The discrete bodies are seated in the longitudinal grooves 24 of the housing section 22 and the sleeve 241 locks the bodies in place within the grooves 24.

In some embodiments, sleeve 241 may be made of a metal or metal alloy for example, but not limited to, copper, copper alloys, aluminium or stainless steel and the spheres 45 are made of a wear-resistant material, for example, but not limited to, metals, composites, or carbides.

In some embodiments, portions of some or all of spheres 45 project radially outward past the external faces of rings 41, 42. In such embodiments the projecting spheres 45 or other shaped discrete bodies therefore act as the first contact impact zone on the external surface of the collar 40, 240. The discrete bodies may also project radially outward from the external surfaces of the male and female members 20, 30. The projected surface of the discrete bodies acts to deflect impact stresses and to resist wear due to impact, friction, and cavitation. In an example embodiment, spheres 45 or other bodies project by about 0.05 inches to 0.1 inches outwardly relative to outer faces of rings 41, 42. In some embodiments, some or all of the spheres or other discrete bodies form a helical pattern of projecting bodies that winds around the housing.

The projecting discrete bodies may serve as wear indicators. Inspection of the discrete bodies may be used to determine whether the housing (or portions thereof) needs to be replaced or repaired.

In some embodiments, most of spheres 45 (or other discrete bodies) do not project radially past the external surfaces of rings 41, 42. A few spheres 45 may be mounted so that they do project radially past the external surfaces of rings 41, 42. The projecting spheres or other discrete bodies may serve as wear indicators. Where spheres 45 engage longitudinal grooves 24, some spheres 45 may be made to project radially farther than others by making a few of longitudinal grooves 24 shallower than others and/or by providing shallower portions in one or more of the longitudinal grooves. For example, several of longitudinal grooves 24 spaced apart around the circumference of male member 20 may be made shallower than others. In a specific example embodiment, four of grooves 24 angularly spaced apart by 90 degrees from one another are made shallower than the remainder of longitudinal grooves 24.

In some embodiments some or all of discrete bodies (e.g. spheres 45) are recessed below the outermost surfaces of rings 41 and 42. The distance may be selected such that the discrete bodies begin to protrude when the rings have been worn to the point that the housing has reached or is approaching its wear limit.

In alternative embodiments (not shown) longitudinal grooves 24 are not present or are replaced with an alternative structural feature to lock the collar 40, 140, 240 in place. For example, the housing section 22 may include individual surface depressions which correspond in shape to the discrete bodies of the collar, or the housing section 22 may include surface protrusions which secure the spheres 45 and/or the rings 41, 41*a*, 41*b*, 42 of the collar 40 or the rings of the helical spring 141 of the collar 140 and secure it in place to prevent rotation or torsional movement. The collar 40, 140, 240 may additionally or alternatively be secured into place in the housing section 22 using adhesives or plastics.

In the embodiments described herein, the collar 40, 240 comprises a framework which may comprise the rings 41, 41*a*, 41*b*, 42 of the embodiments of FIGS. 5 to 11, the helical spring 141 of the embodiment of FIG. 12, or the sleeve 241 of the embodiment of FIG. 12. The framework may be made of materials which are wear-resistant. The framework may be made of a metal or metal alloy, for example, but not limited to, copper, copper alloys, aluminium or stainless steel. Alternatively, or additionally the framework may be made of plastic, a plastic coated metal, epoxy or thermoplastic. In some embodiments, exterior faces of rings 41, 41*a*, 41*b*, 42 have a hardness of at least Rc 20, 40, 50, 55, 60, 65, 67, or 69.

The discrete bodies may be made of materials which are wear-resistant. The discrete bodies may be made of a metal or metal alloy, for example, but not limited to, copper, copper alloys, aluminium or stainless steel, or the discrete bodies may be made of for example, but not limited to, ceramic, plastic, plastic coated metals, composite or carbides. Exemplary ceramics include, but are not limited to, zirconium dioxide, yttria tetragonal zirconia polycrystal (YTZP), silicon carbide, or composites.

The geometry of the collar 40, 240 may allow for determination of downhole wear characteristics of the housing 100 following each successive use of the drilling rig as the wear rates between the discrete bodies, and other materials of the collar 40, 240 can be calculated and extrapolated.

More specifically, as the surface of the discrete bodies project above the external and internal surface of the rest of the collar 40, 240, the discrete bodies act as a wear indicator following each successive use of the drilling rig. Better understanding of downhole wear characteristics may result in better planning and greater confidence in the deployment of older or used tools. The downhole wear characteristics can also be used to determine when the housing 100 has reached the end of its life.

The collar 40, 240 beneficially may provide mechanical strength, structure, stiffness and durability to the housing 100 and restricts bending of housing 100. Use of a collar 40, 240 of the disclosed embodiments may increase, amongst other things, the overall bending strength, stiffness, torsion strength and toughness of a mud motor housing 100.

A number of variations are possible. For example, wear-resistant rings could be provided in collar 40 in place of spheres 45 or other bodies in some embodiments.

In any of the embodiments described herein, exposed surfaces at one or both ends of collar 40 (e.g. exposed parts of male member 20 and female member 30) are hardened (e.g. hard-faced, hard-banded, or made of hard materials to provide improved abrasion resistance).

In some embodiments a mud motor housing comprises a plurality of axially-arranged sections coupled together at joints. In such embodiments a collar as described herein may be provided at or adjacent to one or more of the joints. In some embodiments short collars as described herein are provided at or adjacent to a plurality of joints. In some embodiments a collar is provided at or on one or both sides of all joints in the mud motor housing. By way of example only, such collars may have lengths shorter than about 3 inches in some embodiments (for example, collars in the range of 1 to 2 inches in length may be provided).

In some embodiments, the joints in the mud motor housing comprise couplings which include shoulders on either side of the joint and the collar is compressed between such shoulders at one or more such joints. In such embodiments, material filling voids around the spheres or other discrete bodies may additionally assist in sealing the joints.

Another aspect provides methods for making housings. A method according to an example embodiment comprises placing a collar around a tubular housing portion and coupling the housing portion to at least one other part to yield an assembly wherein the collar is located between first and second shoulders. The method then axially compresses the collar.

Constructions as described herein, when applied to a housing for a mud motor, may advantageously stiffen the mud motor, provide wear-resistance (particularly beneficial in horizontal drilling), and/or assist in centralizing the mud motor in a borehole. Good centralization can help to achieve straighter drilling.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those of skill in the art. The invention in its broader aspects is therefore not limited to the specific details, representative apparatus and methods, and illustrative examples shown and described.

Certain modifications, permutations, additions and sub-combinations thereof are inventive and useful and are part of the invention. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back"," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g., an assembly, ring, body, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

The invention claimed is:

1. A housing for a downhole component, the housing comprising a collar having a pair of longitudinal ends spaced apart from each other and a bore therethrough, the collar comprising:

(a) a framework; and (b) a plurality of discrete bodies spaced about the framework, a portion of each of the plurality of discrete bodies protruding above a surface of the framework;

wherein:

the framework and the plurality of discrete bodies extend between the longitudinal ends of the collar;

the framework comprises a plurality of rings with opposed side faces and at least some of the discrete bodies are engaged between side faces of adjacent ones of the plurality of rings;

the plurality of rings comprises a pair of end rings and at least some of the plurality of discrete bodies are positioned between the end rings; and each of the pair of end rings comprise an outer side face and an opposed inner side face with the inner side faces facing each other, each of the inner side faces including a plurality of spaced inner side face end ring surface depressions thereon, wherein each inner side face end ring surface depression is configured to receive a portion of one of the plurality of discrete bodies therein;

wherein at least one of the plurality of rings with opposed side faces is tapered in thickness such that the outer part, furthest from the bore, is thicker than the inner part, closest to the bore.

2. A housing as claimed in claim 1 wherein the framework comprises a wear-resistant material.

3. A housing as claimed in claim 2, wherein the framework comprises a metal or metal alloy.

4. A housing as claimed in claim 1, wherein the plurality of discrete bodies are spheres.

5. A housing as claimed in claim 1 wherein the plurality of discrete bodies comprise a wear-resistant material.

6. A housing as claimed in claim 5 wherein the plurality of discrete bodies comprise carbide.

7. A housing as claimed in claim 1, wherein the plurality of rings further comprises one or more than one internal ring positioned between the pair of end rings, wherein at least some of the plurality of discrete bodies are positioned between each of the end rings and the internal ring.

8. A housing as claimed in claim 7, wherein the end rings are thicker than the internal ring.

9. A housing as claimed in claim 1, wherein the plurality of rings further comprises one or more than one internal ring positioned between the pair of end rings, wherein the internal ring comprises two opposed side faces with one of the opposed side faces facing the inner side face of one of the pair of end rings and the other of the opposed side faces facing the inner side face of the other of the pair of end rings, each of the opposed side faces including a plurality of spaced internal ring surface depressions thereon, wherein each internal ring surface depression is configured to receive a portion of one of the plurality of discrete bodies therein.

10. A housing as claimed in claim 9, wherein the internal ring surface depressions of one of the opposed side faces are offset from the internal ring surface depressions of the other of the opposed side faces.

11. A housing as claimed in claim 9, wherein the internal ring surface depressions of one of the opposed side faces align with the internal ring surface depressions of the other of the opposed side faces.

12. A housing according to claim 1, the housing further comprising:

(a) a female member having a female mating section; and (b) a male member having a male mating section and a housing section, the male mating section being inserted into the female mating section and coupled to the female mating section whereby the male and female mating sections overlap;

wherein the collar is located between first and second shoulders respectively on the male and female members and is positioned on the housing section.

13. A housing as claimed in claim 12 wherein the framework is dimensioned to contact the housing section.

14. A housing for a downhole component, the housing comprising a collar having a pair of longitudinal ends spaced apart from each other and a bore therethrough, the collar comprising:

(a) a framework; and (b) a plurality of discrete bodies spaced about the framework, a portion of each of the plurality of discrete bodies protruding above a surface of the framework;

wherein:

the framework and the plurality of discrete bodies extend between the longitudinal ends of the collar;

the framework comprises a plurality of rings with opposed side faces and at least some of the discrete bodies are engaged between side faces of adjacent ones of the plurality of rings;

the plurality of rings comprises a pair of end rings and at least some of the plurality of discrete bodies are positioned between the end rings; and each of the pair of end rings comprise an outer side face and an opposed inner side face with the inner side faces facing each other, each of the inner side faces including a plurality of spaced inner side face end ring surface depressions thereon, wherein each inner side face end ring surface depression is configured to receive a portion of one of the plurality of discrete bodies therein;

wherein the outer side faces of the pair of end rings include a plurality of spaced outer side face end ring surface depressions thereon, wherein each outer side face end ring surface depression is configured to receive a portion of one of the plurality of discrete bodies therein.

15. A housing as claimed in claim 14 wherein the framework comprises a wear-resistant material.

16. A housing as claimed in claim 15, wherein the framework comprises a metal or metal alloy.

17. A housing as claimed in claim 14, wherein the plurality of discrete bodies are spheres.

18. A housing as claimed in claim 14 wherein the plurality of discrete bodies comprise a wear-resistant material.

19. A housing as claimed in claim 18 wherein the plurality of discrete bodies comprise carbide.

20. A housing as claimed in claim 14, wherein the plurality of rings further comprises one or more than one internal ring positioned between the pair of end rings, wherein at least some of the plurality of discrete bodies are positioned between each of the end rings and the internal ring.

21. A housing as claimed in claim 20, wherein the end rings are thicker than the internal ring.

22. A housing as claimed in claim 14, wherein the plurality of rings further comprises one or more than one internal ring positioned between the pair of end rings, wherein the internal ring comprises two opposed side faces with one of the opposed side faces facing the inner side face of one of the pair of end rings and the other of the opposed side faces facing the inner side face of the other of the pair of end rings, each of the opposed side faces including a plurality of spaced internal ring surface depressions thereon, wherein each internal ring surface depression is configured to receive a portion of one of the plurality of discrete bodies therein.

23. A housing as claimed in claim 22, wherein the internal ring surface depressions of one of the opposed side faces are offset from the internal ring surface depressions of the other of the opposed side faces.

24. A housing as claimed in claim 22, wherein the internal ring surface depressions of one of the opposed side faces align with the internal ring surface depressions of the other of the opposed side faces.

25. A housing for a mud motor, the housing comprising:

(a) a female member having a female mating section;

(b) a male member having a male mating section and a housing section, the male mating section being inserted into the female mating section and coupled to the female mating section whereby the male and female mating sections overlap; and (c) a collar positioned on the housing section and located between first and second shoulders respectively on the male and female members, the collar having a pair of longitudinal ends spaced apart from each other and a bore therethrough, the collar comprising:

(i) a framework; and (ii) a plurality of discrete bodies spaced about the framework, a portion of each of the plurality of discrete bodies protruding above a surface of the framework; wherein:

the framework and the plurality of discrete bodies extend between the longitudinal ends of the collar;

the framework comprises a plurality of rings with opposed side faces and at least some of the discrete bodies are engaged between side faces of adjacent ones of the plurality of rings;

the plurality of rings comprises a pair of end rings and at least some of the plurality of discrete bodies are positioned between the end rings; and each of the pair of end rings comprise an outer side face and an opposed inner side face with the inner side faces facing each other, each of the inner side faces including a plurality of spaced inner side face end ring surface depressions thereon, wherein each inner side face end ring surface depression is configured to receive a portion of one of the plurality of discrete bodies therein the collar located between;

wherein the housing section is configured to interact with at least part of the protruding portion of the plurality of discrete bodies of the collar to impede rotation of the collar relative to the housing section.

26. A housing as claimed in claim 25, wherein the housing section comprises a plurality of longitudinally extending grooves on an external surface thereof and at least part of the protruding portion of the plurality of discrete bodies is received in one of the plurality of longitudinally extending grooves.

27. A housing for a mud motor, the housing comprising:

(a) a female member having a female mating section;

(b) a male member having a male mating section and a housing section, the male mating section being inserted into the female mating section and coupled to the female mating section whereby the male and female mating sections overlap; and (c) a collar positioned on the housing section and located between first and second shoulders respectively on the male and female members, the collar having a pair of longitudinal ends spaced apart from each other and a bore therethrough, the collar comprising:

(i) a framework; and (ii) a plurality of discrete bodies spaced about the framework, a portion of each of the plurality of discrete bodies protruding above a surface of the framework; wherein:

the framework and the plurality of discrete bodies extend between the longitudinal ends of the collar;

the framework comprises a plurality of rings with opposed side faces and at least some of the discrete bodies are engaged between side faces of adjacent ones of the plurality of rings;

the plurality of rings comprises a pair of end rings and at least some of the plurality of discrete bodies are positioned between the end rings; and each of the pair of end rings comprise an outer side face and an opposed inner side face with the inner side faces facing each other, each of the inner side faces including a plurality of spaced inner side face end ring surface depressions thereon, wherein each inner side face end ring surface depression is configured to receive a portion of one of the plurality of discrete bodies therein the collar located between:

wherein:

the male member further comprises a shoulder section including a first annular shoulder, wherein the collar is positioned between the first annular shoulder and a second annular shoulder on the female section; and at least one of the first and second annular shoulders comprises a plurality of spaced shoulder surface depressions thereon, wherein each shoulder surface depression is configured to receive a portion of one of the plurality of discrete bodies therein.

* * * * *